United States Patent [19]

Reifers et al.

[11] 4,025,038

[45] May 24, 1977

[54] EGG CARTON

[75] Inventors: Richard F. Reifers, New Canaan, Conn.; Kenneth D. Bixler, Huntington, N.Y.; Henry A. Lord, Cape Elizabeth, Maine

[73] Assignee: Diamond International Corporation, New York, N.Y.

[22] Filed: Jan. 30, 1976

[21] Appl. No.: 654,017

Related U.S. Application Data

[63] Continuation of Ser. No. 609,078, Aug. 29, 1975, abandoned.

[52] U.S. Cl. ..... 229/2.5 EC; 206/45.31; 229/44 EC; 229/29 M

[51] Int. Cl.[2] ..... B65D 85/32

[58] Field of Search ..... 229/44 EC, 45 EC, 2.5 EC, 229/29 M; 206/45.31, 503, 508; 217/26.5

[56] References Cited

UNITED STATES PATENTS

| | | | |
|---|---|---|---|
| 2,591,446 | 4/1952 | Lennon | 229/2.5 EC |
| 2,815,162 | 12/1957 | Grant | 229/2.5 EC |
| 2,885,136 | 5/1959 | Grant | 229/2.5 EC |
| 3,327,918 | 6/1967 | White | 229/29 M |
| 3,362,605 | 1/1968 | Bixler | 229/29 M |
| 3,447,731 | 6/1969 | Lehmann | 229/45 EC |
| 3,471,078 | 10/1969 | Seest et al. | 229/45 EC |
| 3,655,110 | 4/1972 | Eisenbach | 229/44 EC |
| 3,661,317 | 5/1972 | Noguchi | 229/29 M |
| 3,664,574 | 5/1972 | Pearl et al. | 229/44 EC |
| 3,672,693 | 6/1972 | Weir | 229/45 EC |
| 3,771,712 | 11/1973 | Richards | 229/29 M |
| 3,865,299 | 2/1975 | Crabtree | 229/29 M |
| 3,920,178 | 11/1975 | Moller | 229/2.5 EC |

*Primary Examiner*—William Price
*Assistant Examiner*—Bruce H. Bernstein
*Attorney, Agent, or Firm*—Karl W. Flocks

[57] ABSTRACT

A molded egg carton having a windowed cover and a cellular tray for the reception of eggs in which the windowed cover includes downposts and the tray includes up posts and in which the downposts have an offset male portion and the up posts are formed with a recess in their uppermost portion adapted to receive the offset lowermost tip of the offset male portion. The windows in the cover are on each side of the downposts and are set in relatively steep walls which form parts of the downposts. The windows are provided with "eye lid" formations.

12 Claims, 8 Drawing Figures

EGG CARTON

This application is a continuation of applicants' pending application Ser. No. 609,078, filed Aug. 29, 1975 now abandoned.

BACKGROUND OF THE INVENTION

This invention relates to new and improved molded egg carton construction which may be formed from pulp or foam or the like. More particulary, this invention relates to a carton of the type having viewing apertures or windows, but having greater strength and product protection characteristics than the known constructions of this type.

The construction of the egg carton is suitable for what is known in the trade as a 2 × 6 egg carton or a 2 × 5 egg carton or a "twin-6er" which comprises separable sections each of which contain six cells in two rows of three each.

SUMMARY OF THE INVENTION

The present invention has been conceived with an aim toward providing an egg carton construction or the like having viewing apertures or windows, which construction is characterized by more positive separation of eggs or like contents thereof.

The present invention has also been conceived with the object of providing a carton with improved stacking strength over that of the known cartons of this type.

Another object of the present invention is to provide a more stable tray and cover arrangement in a carton, one in which the cover may be in a sense locked to the tray against misalignment therebetween.

Still another object of the present invention is to provide a cellular tray construction in an egg carton which will aptly accommodate a wide size range of eggs from small sizes to extra large sizes and yet adequately cushion and protect whatever sizes are received therein.

Yet another object of the present invention is to provide an egg carton with cell post elements of such construction as will separate and guide eggs in the automated loading operation.

A further object of the present invention is to provide an egg carton construction characterized by improved strength and force transmission from cover to the cells.

It is moreover an object of the present invention to provide an egg carton with post construction including a soft area at the critical point of egg contact which will result in better cushioning.

DETAILED DESCRIPTION OF THE INVENTION

Figure 1:
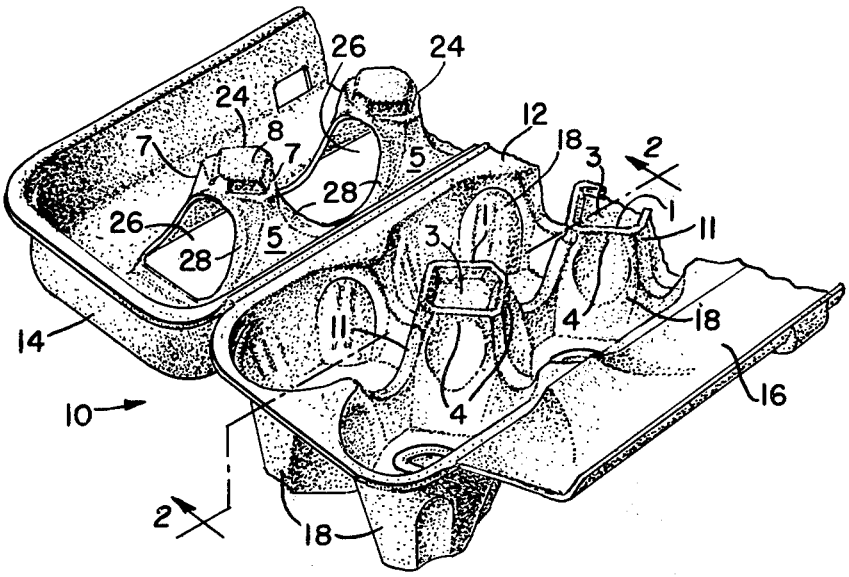
FIG. 1 is a fragmentary view in perspective of one form of the present invention.
Figure 2:
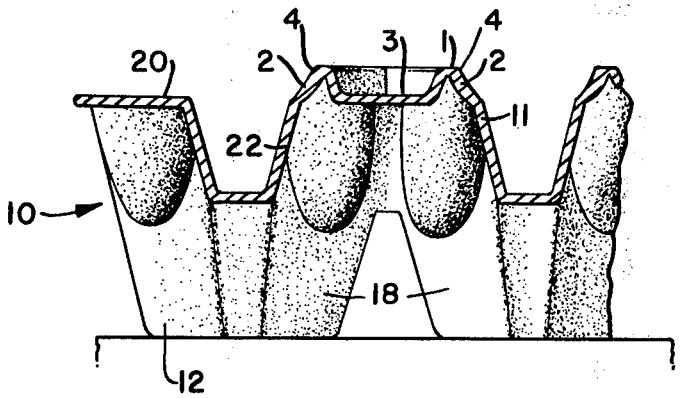
FIG. 2 is a view taken along section 2—2 of FIG. 1 on an enlarged scale.

Referring now more particularly to the drawings, the reader will readily see in FIGS. 1–6 that the present invention comprises a molded carton 10 of pulp or foam or the like. In a preferred embodiment of the invention, carton 10 includes a cellular tray 12, a cover 14, and a lock flap 16. The tray 12 is formed with a plurality of cells 18 in which eggs or the like may be protectively contained. The cells 18 are generally polygonal or of closed geometrical configuration and in the present embodiment are at least five-sided with one of the sides of each end cell being provided on or associated with an upwardly extending member referred to as an up post 11 and each of two sides of each intermediate cell being provided on or associated with one of two adjacent up posts 11. Tray 12 includes a generally horizontal flange 20 on which cover 14 rests as it is closed in mating condition with tray 12. In the closed mating condition of cover 14 and tray 12 up post 11 extends upwardly beyond flange 20 to an uppermost tip or rim portion 1 which extends above and beyond the cellular portion of tray 12.

In the uppermost portion of the up post 11 there is a crater or crater-like formation 3 of closed geometrical configuration. Each up post 11 has side walls with non-uniform inner and outer sides which may be seen in FIG. 2 as a bulging portion 2 near the top of the up post 11 where the bulging portion 2 of the side wall of the up post 11 is thicker than the lower portion 22 of the up post 11.

The up posts 11 separate the eggs and guide the eggs when they are automatically loaded into the carton 10. The up posts 11 provide egg separation during shipment.

The cover 14 which mates with the tray 12 over the egg cells 18 include downwardly extending downposts 24 in the closed condition of cover 14. On each side of each downpost 24 there is an aperture or window 26 through which contents of the carton 10 may be viewed even when the cover 14 is closed. Each downpost 24 extends to a tip 8 that is of closed geometrical configuration set inwardly so as to fit within crater 3 at the uppermost tip or rim portion 1 of an up post 11.

Figure 3:
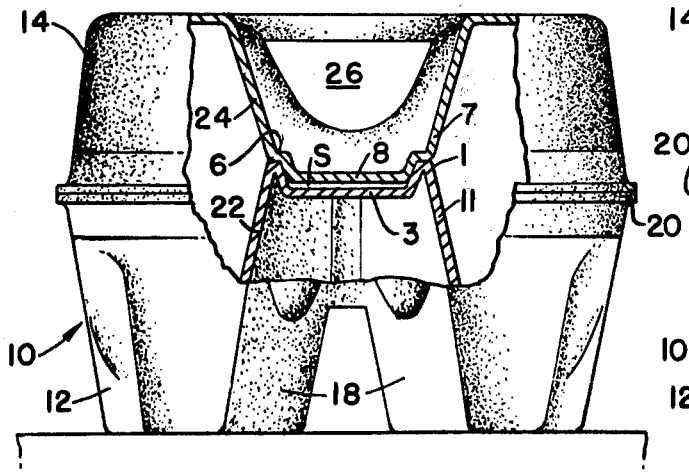
FIG. 3 is an end view of the carton of FIG. 1 in a closed condition and on an enlarged scale.
Figure 4:
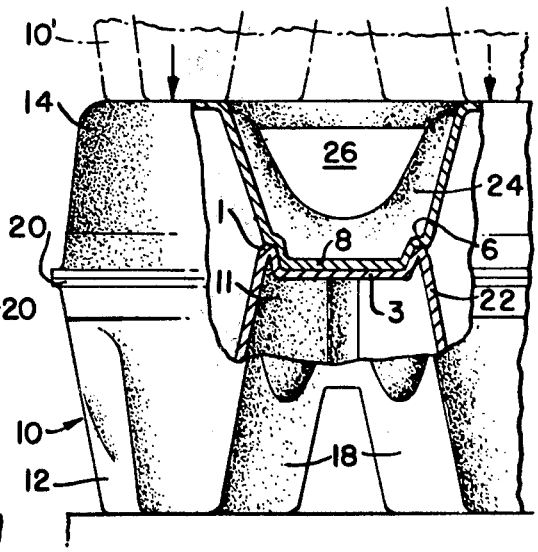
FIG. 4 is a fragmentary end view of the carton in FIG. 3 showing the effect of loaded cartons stacked thereon.
Figure 5:
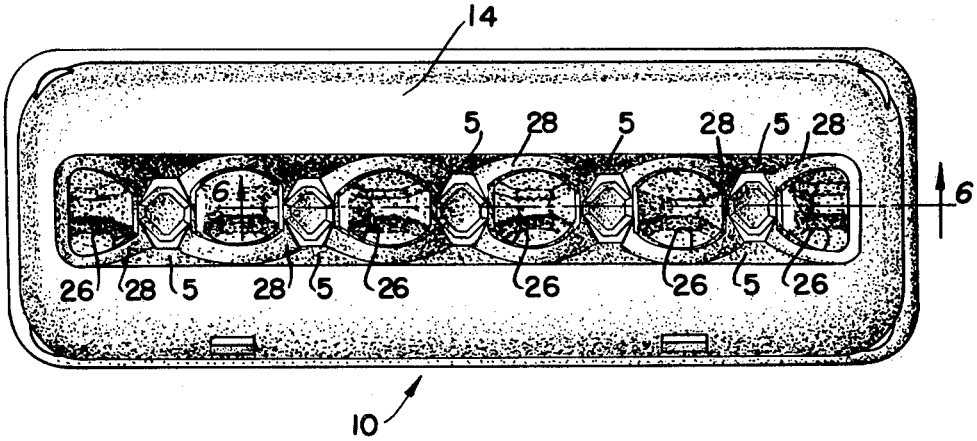
FIG. 5 is a top plan view of the closed carton of FIG. 3 on the scale of FIG. 1.

It is noted in FIGS. 3 and 5 that when the cover 14 of the egg carton is first closed the very tip 8 of the downposts 24 do not touch the bottom of the crater 3 in the up post 11 and there is a space S initially between the very tip 8 of the downposts 24 and the crater 3 of the up posts 11 when the carton 10 is first closed. After the carton 10 is loaded with eggs and closed and other cartons 10' loaded with eggs are stacked as illustrated in FIG. 4 in an egg case for shipment, a shoulder 6 of the downpost 24 first engages the tip or rim 1 of the crater 3 on the up post 11 and then if the loading is heavy, the tip 8 of the downpost 24 may touch the bottom of the crater 3 of the up post 11.

Figure 6:
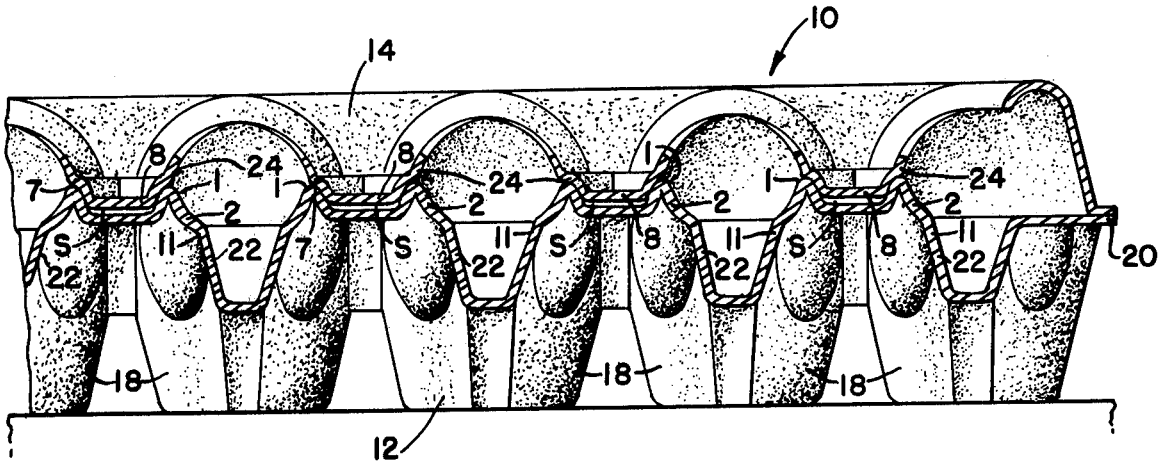
FIG. 6 is an enlarged view taken along section 6—6 of FIG. 5.

The cover 14 when closed shows the windows 26 as having "eye lid" formations 28 which extend from very steep walls 5 forming sides of the downposts 24. Each "eye lid" formation 28 as may be seen in FIGS. 1, 5 and 6 is in the form of an arcuate portion integral with but offset from the plane of a wall 5, extends along and cooperates with another "eye lid" formation to surround the periphery of an aperture 26. The "eye lid" formations 28, because they are offset from the plane of walls 5 with which they are integral and thus in combination with the side walls 5 form multi-planar wall portions of each downpost 24, inherently enhance the vertical load bearing capacity of such downposts 24.

The stepped mating formation between the downpost 24 and the up post 11 transmits load in an advantageous manner in that the initial force transmission is associated with the horizontal portion of the shoulder 6 and the crater tip or rim 1 of up post 11. A secondary bearing area is provided as the downpost tip 8 contacts the bottom 3 of the crater 3 of the up post 11 upon additional loading. A side wall portion 7 of side wall 5 provides added separation structure for protection of the eggs.

When the carton 10 is closed and in use, the structure recited interacts to produce complete egg protection in a manner superior to that available in previous carton structures. The egg separation produced by the cover downposts 24 and the tray up posts 11 are positive. The vertical stacking strength of the carton exceeds that of previous egg cartons. The stepped in formation of the tip 8 of the downposts 24 and the crater 3 formation of the top of the up posts 11 contribute to this strength. The additional thickness in bulging portion 2 at the upper end of the up posts 11 contributes to the strength. The downposts 24 of the cover 14 lock into the crater 3 of the up posts 11 of the tray 12 and stabilize the cover 14 against mis-aligned to maintain package strength in a novel manner different from a straight line engagement in the sense that the engagement takes place in the shape of a closed polygon.

An important advantage of crater 3 resides in the fact that a yieldable or soft area 4 is provided in up post 11 along each side thereof at the critical point of egg contact. The effect of yieldable or soft area 4, as provided in the present invention, is in contrast to a more rigid and relatively unyieldable area of contact where a plateau would be extended straight across the top of up post 11 instead of the crater 3 of the present application.

Figure 7:
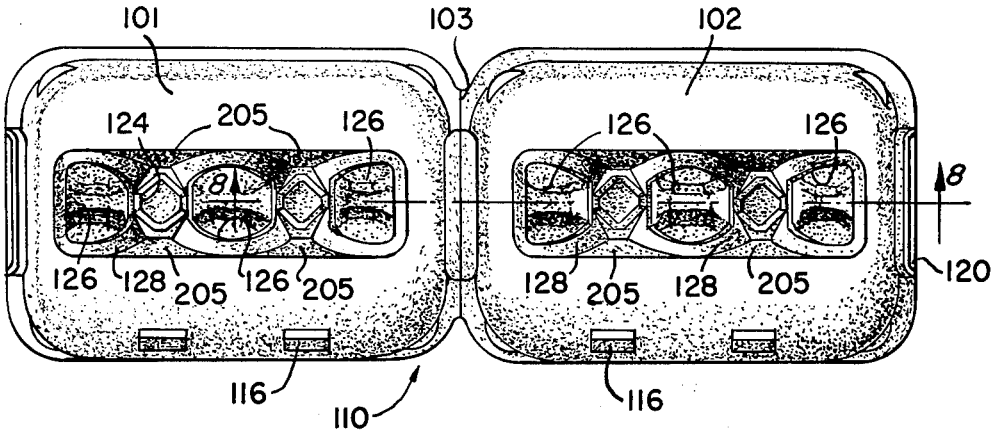
FIG. 7 is a top plan view of an alternative form of the present invention.
Figure 8:
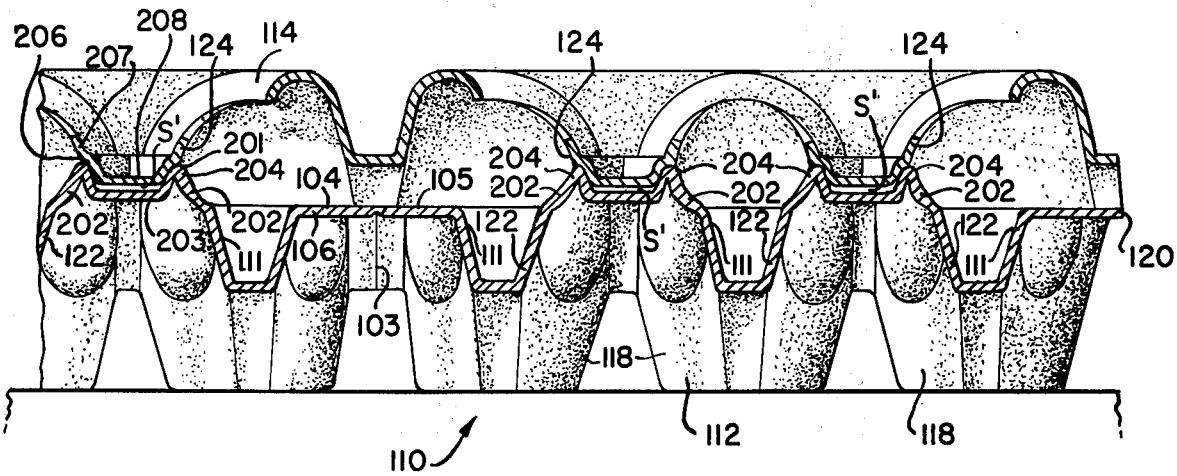
FIG. 8 is an enlarged view taken along section 8—8 in FIG. 7.

An alternative of the embodiment of FIGS. 5 and 6 described in detail above may be seen in FIGS. 7 and 8. Whereas, FIGS. 5 and 6 show the invention embodied in the form known in the trade as a 2 × 6 egg carton. FIGS. 7 and 8 show the invention embodied in the form known as a "twin-6er" carton generally designated 110 and comprising separable twin sections 101 and 102. "Twin-6er" carton 110 is formed with a weakened sectional plane 103 along which sections 101 and 102 may be separated. Like carton 10, as described above, carton 110 includes a cellular tray 112, a cover 114, and a lock flap 116. The tray 112 is formed with a plurality of cells 118 in which eggs or the like may be protectively contained. The cells 118 are generally polygonal and in the present embodiment are also at least five-sided with one of the sides of each end cell being provided on or associated with an upwardly extending member referred to as an up post 111 and each of two sides of each intermediate cell being provided on or associated with one of two adjacent up posts 111, differing from the carton 10 in the respect that in place of central up post 11 and downpost 24 intermediate twin flange portion 104 is provided on tray 112 which upon separation of sections 101, 102 become end flanges 105, 106. Tray 112 also includes a generally horizontal flange 120 extending therearound and on which cover 114 rests as it is closed in mating condition with tray 112. In the closed mating condition of cover 114 and tray 112 up post 111 extends upwardly beyond flange 120 to an uppermost tip or rim portion 201 which extends above and beyond the cellular portion of tray 112.

In the uppermost portion of the up post 111 there is a crater or crater-like formation 203. Each up post 111 has side walls with non-uniform inner and outer sides which may be seen in FIG. 2 as a bulging portion 202 near the top of the up post 111 where the bulging portion 202 of the side wall of the up post 111 is thicker than the lower portion 122 of the up post 111.

The up posts 111 separate the eggs and guide the eggs when they are automatically loaded into the carton 110. The up posts 111 provide egg separation during shipment.

The cover 114 which mates with the tray 112 over the egg cells 118 includes downwardly extending downposts 124 in the closed condition of cover 114. On each side of each downpost 124 there is an aperture or window 126 through which contents of the carton 110 may be viewed even when the cover 114 is closed. Each downpost 124 extends to a tip 208 that is set inwardly so as to fit within crater 203 at the uppermost tip or rim position 201 of an up post 111.

When the cover 114 of the egg carton 110 is first closed, as may be seen in FIG. 8, the very tip 208 of the downposts 124 do not touch the bottom of the crater 203 in the up post 111 and there is a space S′ initially between the very tip 208 of the downposts 124 and the crater 203 of the up post 111 when the carton 110 is first closed. After the carton 110 is loaded with eggs and closed and other cartons loaded with eggs are stacked thereon in a manner as illustrated in FIG. 4 in an egg case for shipment in connection with carton 110, a shoulder 206 of the downpost 124 will first engage the tip or rim 201 of the crater 203 on the up post 111 and then if the loading is heavy, the tip 208 of the downpost 124 may touch the bottom of the crater 203 of the up post 111.

The cover 114 when closed shows the windows 126 as having "eye lids" formations 128 which extend from very steep walls 205 forming sides of the downposts 124.

The stepped mating formation between the downpost 124 and the up post 111 of carton 110 transmits load in an advantageous manner in that the initial force transmission is associated with the horizontal portion of the shoulder 206 and the crater tip of rim 201 of up post 111. A secondary bearing area is provided as the downpost tip 208 contacts the bottom 203 of the crater 203 of the up post 111 upon additional loading. A side wall portion 207 of side wall 205 provides added separation structure for protection of the eggs.

When the carton 110 is closed and in use, the structure of the alternative form of the present invention recited interacts to produce complete egg protection in a manner superior to that available in previous carton structures. The egg separation produced by the cover downposts 124 and the tray up posts 111 are positive. The vertical stacking strength of the carton exceeds that of previous egg cartons. The stepped in formation of the tip 208 of the downposts 124 and the crater 203 formation of the top of the up posts 111 contribute to this strength. The additional thickness in bulging portion 202 at the upper end of the up posts 111 contributes to the strength. The downposts 124 of the cover 114 lock into the crater 203 of the up posts 111 of the tray 112 and stabilize the cover 114 against mis-alignment to maintain package strength in a novel manner different from a straight line engagement in the sense that the engagement takes place in the shape of a closed polygon.

An important advantage of crater 203 resides in the fact that a yieldable or soft area 204 is provided in up post 111 along each side thereof at the critical point of egg contact. The effect of yieldable or soft area 204, as provided in the present invention, is in contrast to a more rigid and relatively unyieldable area of contact where a plateau would be extended straight across the top of up post 111 instead of the crater 203 of the present application.

It will be obvious to those skilled in the art that various changes may be made without departing from the scope of the invention and the invention is not to be considered limited to what is shown in the drawings and described in the specification.

What is claimed is:

1. In an egg carton having one or more downposts in the cover and one or more up posts in the tray, apertures formed on each side of a downpost, "eye lids" about the aperture formations, said "eye lids" extending from very steep walls in the cover and around the periphery of each of said apertures, said downposts having a stepped in plug-like formation at its extremity, said plug-like formation being in the shape of a closed polygon, each tray up post having a crater-like formation at its extremity adapted to receive the tip of each downpost, said crater being in the form of a closed polygon, the upper portions of the side walls of the up posts being thicker than other portions of said side walls of said up posts, a step portion of each of said downposts coming to rest on the upper portion of one of said up posts when said carton is initially closed with a space being maintained between the tip of the downpost and the bottom of the crater of the up post, which space may disappear when a plurality of loaded egg cartons are stacked on top of the cover of said carton.

2. In an egg carton comprising a tray in which eggs or the like may be protectively stored and a cover adapted to close over said tray, said tray being of cellular construction and including one or more up posts, each of said one or more up posts having a crater-like formation at its extremity in the form of a closed polygon, each of said one or more up posts also having side walls with upper portions of greater thickness than other portions thereof, said cover when considered from a closed condition thereof having one or more downposts, each of said one or more downposts being in the form of a plug-like formation with a stepped in portion at its extremity and being in the form of a closed polygon, the crater-like formation of each of said one or more up posts being adapted to receive the stepped in plug-like formation of said one or more downposts, each of said one or more downposts further having oppositely facing apertures formed on two sides thereof and eye lid-like portions extending about the apertures from very steep walls on said cover, said stepped in portion of each of said plug-like formation coming to rest on the upper portion of one of said up posts when said carton is initially closed and leaving a space between the extremity of said one or more downposts and the bottom of the crater of said one or more up posts with said space being closed to a greater degree of disappearing from the load of one or more cartons loaded with eggs stacked on top of said cover.

3. The construction as defined in claim 2 wherein said one or more up posts and said one or more downposts are in fact a plurality of longitudinally spaced up posts along the length of said tray and a plurality of longitudinally spaced downposts along the length of said cover.

4. The construction as defined in claim 3 wherein said cellular construction comprises a plurality of egg receiving or holding cells each of which are of closed geometrical configuration with one side of some cells being formed on an up post and two sides of other cells being formed on adjacent up posts.

5. The construction as defined in claim 4 wherein said tray includes a horizontal flange extending therearound and the extremity of each of said up posts extends at least a short distance above said flange.

6. The construction as defined in claim 5 wherein the area around the tip of each of said up posts is of greater thickness than that around the lower portions of said up posts.

7. In an egg carton comprising a tray of celular construction and having one or more up posts extending upwardly therefrom and a cover having one or more downposts extending downwardly therefrom, said up posts and said downposts having formed thereon first means defining an initial force transmission therebetween and second means defining a secondary bearing area therebetween, said first means comprising a plurality of plug-like formations each including a stepped in portion permitting an initial force transmission to the upper portions of said post and between said cover and said tray when said cover is initially closed with a space being maintained between the tips of said plug formations and the said secondary bearing area said second means comprising a plurality of crater-like formations adapted to receive said plug-like formations, permitting a load such as loaded cartons of eggs stacked upon said cover to transmit force to said secondary bearing area at which time said space may disappear.

8. The tray of claim 7 wherein each of said crater-like formation is formed in one of said up posts and is directed upwardly and includes a lateral portion providing a yieldable or soft area for egg contact.

9. The carton of claim 6 wherein said carton is formed with a weakened central section whereby said carton may be separated into two halves.

10. The carton as defined in claim 9 wherein the carton is formed from pulp, foam or like material.

11. In an egg carton having a tray and a cover with one or more downposts in the cover and one or more up posts in the tray, apertures formed on each side of a downpost, "eye lid" formations extending around the apertures, said "eye lid" formations extending from very steep walls in the cover and in offset relationship therewith, said downposts having a stepped in plug-like formation at its extremity, said plug-like formation being in the shape of a closed polygon, each tray up post having a crater-like formation at its extremity adapted to receive the tip of each downpost, said crater being in the form of a closed polygon, the upper portions of the side walls of the up posts being thicker than other portions of said side walls of said up posts, said cover being constructed so that upon being initially closed stepped inportions of each of said plug-like formation effect an initial force transmission section with respct to the upper portions of said up posts and a space between the tip of the downpost and the bottom of the crater of the up post will be maintained, which space may be closed so as to disappear when a plurality of loaded egg cartons are stacked upon the closed cover.

12. An egg carton having a cover with one or more downposts and a tray of cellular construction with one or more up posts, said downposts having a stepped in plug-like formation at its extremity, said plug-like formation being in the shape of a closed polygon, each tray up post having a crater-like formation at its extremity adapted to receive the tip of each downpost, said crater being in the form of a closed polygon, the upper portions of the side walls of the up posts being thicker than other portions of said side walls of said up posts, a step portion of each of said downposts coming to rest on the upper portion of one of said up posts when said carton is initially closed with a space being maintained between the tip of the downpost and the bottom of the crater of the up post, which space may disappear when a plurality of loaded egg cartons is stacked on top of the cover of said carton.

* * * * *